United States Patent [19]

Hicks, Jr. et al.

[11] 4,121,543

[45] Oct. 24, 1978

[54] PRECOMBUSTION IONIZATION DEVICE

[76] Inventors: Jarvis Byron Hicks, Jr.; Damon John Hicks, both of 48 Glenwood Rd., Colts Neck, N.J. 07722

[21] Appl. No.: 648,406

[22] Filed: Jan. 12, 1976

[51] Int. Cl.[2] ..... F02B 43/08

[52] U.S. Cl. ..... 123/3; 123/119 E; 123/141; 48/180 R

[58] Field of Search ..... 123/119 E, 141, 3; 48/180 R

[56] References Cited

U.S. PATENT DOCUMENTS

| | | | |
|---|---|---|---|
| 1,771,626 | 7/1930 | Hamilton | 123/119 E |
| 2,656,824 | 10/1953 | Devaux | 123/119 E X |
| 2,705,941 | 4/1955 | Unschuld | 123/119 E |
| 2,899,949 | 8/1959 | Hicks | 123/119 E |
| 3,476,095 | 11/1969 | de Laubarede | 123/119 E |
| 3,537,829 | 11/1970 | Ott | 123/119 E X |
| 3,682,608 | 8/1972 | Hicks | 48/180 R |
| 3,885,539 | 5/1975 | Hicks | 123/119 E |
| 3,963,408 | 6/1976 | Youngberg | 123/119 E X |
| 4,031,876 | 6/1977 | Hoots | 123/141 |

*Primary Examiner*—Charles J. Myhre
*Assistant Examiner*—Ira S. Lazarus
*Attorney, Agent, or Firm*—Lerner, David, Littenberg & Samuel

[57] ABSTRACT

Precombustion ionization devices are disclosed for treating the vaporizable liquid fuel in internal combustion engines, including at least one foraminous member prepared from a catalytic metal having an oxide coating on the surface thereof. The foraminous member, or screen, is spaced from the carburetor and the engine intake of the internal combustion engine by means of a supporting gasket. The disclosed precombustion ionization devices may also be attached to a source of relatively high voltage, resulting in increased ionization of the vaporizable liquid fuel thereby, and preventing electropolishing of the metal oxide coating.

23 Claims, 11 Drawing Figures

PRECOMBUSTION IONIZATION DEVICE

FIELD OF THE INVENTION

The present invention is directed to devices for catalytically acting on a carbureted mixture of a vaporizable liquid fuel and air prior to its introduction into the intake manifold of an internal combustion engine. More specifically, the present invention is directed to such catalytic or ionization devices which precondition the mixture of fuel and air for more efficient ignition.

BACKGROUND OF THE INVENTION

The problems generated by the use of internal combustion engines, primarily such as two- and four-stroke cycle internal combustion gasoline engines and the like, generally include problems of both air pollution and of inefficiency. That is, the problems caused by the combustion products and their expulsion into the environment, and the problems caused by the inefficient use of fuel, and/or the use of more expensive fuels and the recent switch to non-leaded fuels. With respect to the former problem, post-combustion devices have been employed, such as exhaust gas catalysts and pollution control valves. With respect to the latter, however, improvements in the engine itself have generally been the main area of development, somewhat reducing pollution, but also reducing efficiency. There have been some suggestions with respect to the use of precombustion devices, that is devices for treating the fuel-air mixture prior to its introduction into the intake manifold of the automobile engine. Thus, for example, U.S. Pat. No. 2,899,949 discloses a precombustion catalyst device of that nature which includes a pair of screens of different catalytic materials, specifically cadmium and nickel for the upstream and downstream screens respectively. In addition, U.S. Pat. No. 3,682,608 discloses an alleged improvement over that precombustion device, in which smaller screen openings are employed, and wherein the screens are dished in order to increase the total surface area of metal over which the gasoline/air mixture flows. In this manner, a tortuous flow passage is created for the carbureted mixture and the time of exposure to the catalytic surfaces is increased. In addition, U.S. Pat. No. 3,885,539 discloses a precombustion device employing a pair of spaced screens having surfaces of different catalytic metals in which a gasket containing an electrolyte such as glycerol forms a high resistance path between the screens and between each screen and the engine ground. In connection with each of these devices, however, the search has continued for a more efficient, and inexpensive method for optimizing engine performance, obtaining mileage improvements, reducing pollution, lowering octane ratings, etc.

On the other hand, U.S. Pat. No. 3,110,294 discloses the application of a magnetic field with ionizing potentials of from about 6 to 120 volts, in order to cause the ionization of a gaseous air-fuel mixture. The patentee thus teaches that he offers a more efficient conbustion of the more thoroughly mixed air/fuel mixture thereby. In addition, U.S. Pat. No. 3,749,545 discloses increasing combustion efficiency by electrostatically influencing the size distribution and trajectory of liquid fuel droplets introduced into a combustion chamber. This is accomplished by electrostatically charging the fuel spray and the walls of the combustion chamber.

Again, attempts have continued to develop a precombustion device which can simply and economically achieve improved results in the form of improved engine efficiency, improved gasoline mileage, reduced pollution, lower octane ratings, decreased knocking, etc., all with regard to both leaded and unleaded fuels.

SUMMARY OF THE INVENTION

In accordance with the present invention, a precombustion ionization device is provided for interposition between the carburetor and the engine intake of an internal combustion engine employing a vaporizable liquid fuel. The precombustion ionization device itself comprises at least one foraminous member including a layer of a catalytic metal thereon, including an oxide coating of that catalytic metal on the surface thereof, and a gasket supporting the foraminous member so that is is spaced from both the carburetor and the engine intake.

In a preferred embodiment of the present invention, the precombustion ionization device comprises at least a pair of foraminous members, each of which includes a layer of catalytic metal thereon, each including an oxide coating of that catalytic metal on the surface thereof. In this embodiment, the gasket supporting each of these members maintains the foraminous members spaced apart from each other, and furthermore from the carburetor and the engine intake.

In another embodiment of the present invention, a source of voltage is attached to the foraminous members, including a layer of an oxide of the catalytic metal thereon. Preferably, a voltage of greater than about 4 volts is applied thereto. It has thus been found that under certain conditions a deterioration in the ability of the foraminous member of the present invention to effect the desired results has been found. In particular, this has occurred after extended useage of the vehicles employing the internal combustion engines of the present invention at sustained high speeds. By employing the embodiment of the present invention, however, it has also been found that this deterioration can be effectively reduced and in some cases fully eliminated. In yet another embodiment of this invention, this effect can be achieved by the proper application of heat to the foraminous member hereof.

In yet another embodiment of the present invention, wherein at least two foraminous members are employed, one in an upstream location and one in a downstream location with respect to the air-fuel mixture traveling towards the intake manifold of the engine, the catalytic metal employed in connection with each foraminous member is different. Thus, in a preferred embodiment, the combination of zinc and nickel has been found to be particularly effective.

In yet another embodiment of the present invention, however, again wherein at least two foraminous members are employed, the catalytic metal employed in connection with each such foraminous member is the same. In this embodiment, the combination of a pair of anodized aluminum foraminous members and of a pair of zinc foraminous members, each including a zinc oxide coating of at least about 0.0001 inches has been found to be particularly effective.

BRIEF DESCRIPTION OF THE DRAWINGS

The invention will be more clearly understood by reference to the description below taken in connection with the accompanying drawings wherein.

DETAILED DESCRIPTION

It has been observed with prior precombustion ionization devices that the devices loose their effectiveness under certain conditions. In particular, this has been most pronounced at cold engine starting and at high throttle settings, for example when the engine was operating under heavy loads or at high speeds, particularly for sustained periods. It is therefore among the primary objects of the present invention to obtain a precombustion ionization device which avoids these difficulties. In addition, with the current use of lead-free fuels, it has been observed that as the length of service increases, there is an increasing tendency to cause an increase in the engine octane requirement therewith. For example, a normal unused engine using lead-free fuel will normally be satisfied with a lead-free fuel having a research octane member of approximately 90. That is, normal gasoline blends comprise various vaporizable volitizable liquid hydrocarbons. Among these, iso-octane is a hydrocarbon of extremely high anti-knocking value, and has been designated as 100 on the octane scale, while normal heptane, a hydrocarbon of extremely low anti-knocking value, is designated as 0 on the octane scale. The blend of hydrocarbon components used therefore determines the overall octane rating of the gasoline employed. Of course, higher octane gasoline blends entail increased cost, principally due to the greater refinery costs related therewith. However, after about 15,000 miles of engine use, it is generally found that the engine begins to detonate, and a lead-free fuel having approximately a 95 research octane number rating is required. Finally, in most cases, after about 25,000 miles of useage, a premium grade of about 98 research octane number is normally required. These effects, however, are substantially overcome by employing the precombustion ionization device of the present invention.

Figure 1:
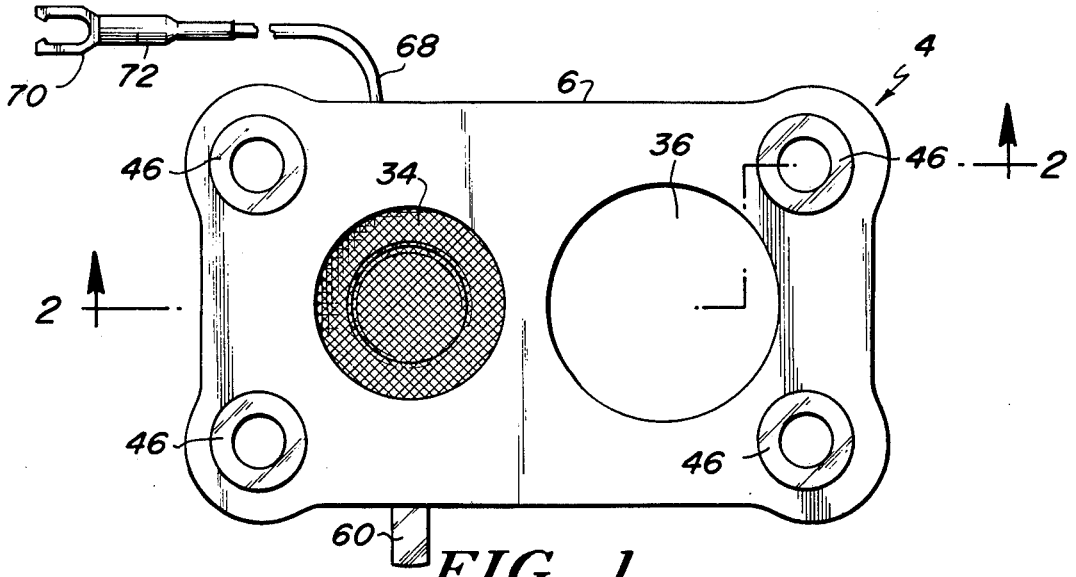
FIG. 1 shows a top elevational view of a precombustion ionization device of the present invention for use in connection with a two-barrel carburetor.

The precombustion ionization device of the present invention is normally located with respect to both the carburetor and the fuel-air inlet of a four stroke internal combustion engine in the manner shown in FIG. 1 of U.S. Pat. No. 3,885,539, that portion of which is hereby incorporated herein by reference thereto. Reference numeral 10 in that Figure thus denotes a conventional four-stroke internal combustion engine, and the precombustion catalyst device of the present invention is associated therewith. The device is interposed between the carburetor and a fuel/air inlet to the engine. Specifically, the precombustion catalyst device is interposed between the outlet of the carburetor and the inlet to the engine intake manifold. The carburetor also includes the usual air control valve and means for regulating the supply of fuel to the mixing chamber of the carburetor.

The fuel, after partial vaporization and reduction of the remainder to minute droplets, and after mixing with air and passage of the mixture to the outlet of the carburetor, instead of flowing directly to the engine intake manifold as in normal practice, is passed through the precombustion ionization device of the present invention.

Figure 8:
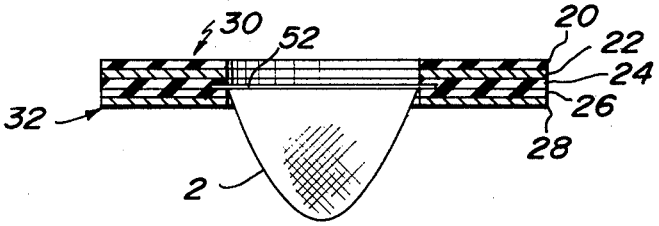
FIG. 8 is a side elevational partly sectional view of another precombustion ionization device of the present invention, for use in a one-barrel carburetor.

The precombustion device itself primarily includes at least one foraminous member in the form of a screen, such as screen 2 shown in FIG. 8. The screen is electrically conductive, and is preferably made of metal in the form of a wire cloth. The cloth preferably includes a base wire cloth, although it is possible to prepare the wire cloth itself from the catalytic metal to be employed. Preferably, the base wire cloth, when utilized, is one having a good thermal conductivity and is fabricated of an inexpensive suitable metal such as iron or steel. The cost of the base wire cloth is not a critical factor. More desirable metals for the base wire cloth, however, are copper and aluminum and alloys thereof due to their better heat conductivity. The cloths are desirably of a very fine mesh. A suitable range of mesh sizes for the wire cloths of this invention is from about 40 by 40 mesh to about 8 by 8 mesh, with wire diameters of from about 0.010 inches to about 0.015 inches for the coarest mesh, and of from about 0.005 inches to about 0.008 inches for the finest mesh. At very fine mesh sizes, i.e. greater than about 40 by 40 mesh, throttling of the engine, and frosting can also occur, and it thus becomes necessary to supply an external source of heat. On the other hand, with mesh sizes of less than 8 by 8 mesh, insufficient catalyst area is provided. The percentage of open area in a direction perpendicular to the plane of open area in a direction perpendicular to the plane of the mesh may vary for the cloths from about 40% up to about 70%.

Figure 2:
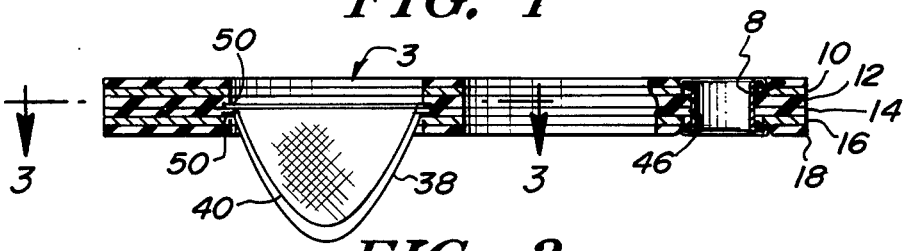
FIG. 2 is a side perspective partially sectional view of the precombustion ionization device of FIG. 2, taken along the lines 2—2 of FIG. 1.

In the case of a pair of foraminous members being employed, i.e. an upstream wire cloth and a downstream wire cloth, as in FIG. 2, the upstream wire cloth will typically have a mesh size of about 20 by 20, with a 0.011 inch diameter wire, and therefore about 400 openings per square inch, while the downstream cloth will typically have a mesh size of about 16 by 16 mesh, with a 0.011 inch diameter wire, and thus have in the order of 256 openings per square inch.

While the cloths themselves may be made entirely of the catalytic material, with the surface thereof then including the oxide of the catalytic material of this invention, as a matter of economy, it is clearly less expensive and just as functionally effective to employ common metals for the base metal cloths and to coat them with the catalytic material and oxides thereof. Coatings of from about 0.0005 to 0.003 inches, and preferably of from 0.0007 to 0.0015 inches, i.e. about .001 inches of the catalytic metals employed may be applied to a base metal, such as steel, by electroplating or immersion of the preformed base wire cloth.

Among the catalytic metals which may be employed therein are included such metals as cadmium, nickel, zinc, aluminum, platinum, etc. However, other catalytic metals with respect to the hydrocarbon fuels normally encountered are possible, such as antimony, beryllium, chromium, cobalt, copper, iron, lead, manganese, molybendum, osmium, ruthenium, selenium, silica, tellurium, thorium, and vanadium. In accordance with the present invention, it is then critical that the wire cloth also include on the surface thereof an oxide coating of the catalytic metal employed. Generally, a metal oxide coating of at least about 0.0001 inches in thickness, preferably greater than about 0.0003 inches, and most preferably from about 0.0003 to 0.0005 inches be effected by "burning" the catalytic metal itself when it is applied by the aforementioned electroplating or immersion techniques, by the application of high current densities to the electroplating or immersion baths.

While the initial electroplating or other techniques employed to apply the catalytic metal to a base wire when a base wire is utilized is not highly critical, it is essential that specific techniques to be employed when the catalytic metal oxide is formed on the surface thereof, i.e. by applying the high current densities to the electroplating or immersion baths as discussed above. Thus, while most of the components of typical electroplating baths are known, it is essential that a minimum of impurities be contained in the plating solution, including the exclusion of any brighteners therefrom. This is, of course, essential in order to produce such burning of the catalytic metals and formation of the catalytic metal oxide layer thereon.

It is also noted that recently more sophisticated techniques have been developed for heat treating such oxidized layers after they are prepared in order to harden same. Such techniques may also be employed in accordance with the present invention, since as will be discussed more fully below with respect to the application of a voltage to the foraminous member of the ionization device hereof, it is essential to maintain the oxide layer and not to electropolish same during its use.

When the catalytic metal employed is aluminum, a heavy oxide coating is obtained in a substantially similar manner by anodizing the aluminum, i.e. by again passing a high voltage electric current through the bath in which the metal is suspended. In such a case, the bath usually contains sulfuric, chromic or oxalic acid.

The wire cloths, either when used alone or with two or more such cloths, extend completely across passageway 34 through device 4, as shown in FIG. 1, passageway 34, connecting the discharge throat of the carburetor to the entrance of the intake manifold, so that it is not possible for the fuel/air mixture to by-pass this cloth or cloths. It is, however, within the ambit of the present invention to by-pass some of the fuel/air mixture, as in a single barrel carburetor, but this will lessen the advantages obtained by this invention. In addition, where staged carburetion is used, it is possible to employ the wire cloths only in the primary opening, since in normal driving the secondary is used less than 10% of the time. Such a device is specifically shown in FIGS. 1–6.

The wire cloth or cloths utilized are preferably dished, a suitable configuration being as shown in the drawings. When two such cloths are employed, both wire cloths are similarly dished, and they are placed in such position that they are substantially uniformly spaced apart. A desirable spacing in the directional flow of the air-fuel mixture is about 3 millimeters.

It is also necessary for the precombustion catalyst device of this invention to include suitable means for supporting either the single or two spaced wire cloths in their aforesaid positions completely spanning the passageway between the carburetor and the intake manifold and, preferably, where two or more such cloths are employed, to integrate the cloths into a single unit while maintaining the cloths separated from each other as discussed above, for easier handling and installation. For this purpose, there is provided a unitary gasket construction as shown in FIGS. 1–6.

The gasket itself, as indicated by gasket 6 in FIG. 1, and gasket layers 8, 10, 12, 14, 16 and 18 in FIG. 2, is preferably highly electrically insulated, eg. has a resistance on the order of about $200 \times 10^6$ ohms. However, the device will function satisfactorily with a lower order of resistance, for example, down to about $100 \times 10^6$ ohms. The gasket itself thus provides a physical support for the screen or wire cloth or cloths, serves to separate the cloths from each other, and also insulates the screen(s) from the engine ground.

Referring specifically to FIGS. 1 and 2, the gasket 6 is itself preferably composed of a series of layers of gasket material. Again, the gasket 6 shown in FIG. 1 includes a pair of openings 34 and 36, 34, the relatively small opening, being the primary opening, in which the foraminous member of the present invention, i.e. screens 38 and 40, are interposed, and opening 36 being the secondary member, which can remain open, thus permitting the fuel utilized at high driving speeds to flow therethrough without passing through a foraminous member. It is, of course, also possible to include a foraminous member, or members, in the secondary opening 36, preferably of the same configuration as the foraminous member included in the primary opening 34. As shown specifically in FIG. 2, the layered gaskets include an initial layer 8, preferably composed of rubber, preferably nitrile rubber. For example, a preferred material is sold under the trademark VELBESTOS, by the Vellumoid Division of Federal-Mogul Corporation of Worcester, Mass. These materials, such as VELBESTOS 250 and VELBESTOS 260, are composed of nitrile (Buna N) rubber and asbestos fiber.

As shown in FIG. 2, a second gasket layer 10 is then provided. Preferably, this layer is a wood-based gasket, preferably a wood pulp gasket. In particular, a preferred material is the product sold under the trademark S-101 by the Colonial Fiber Company of Manchester, Conn. This material is a homogeneous and rigid fiberboard product, preferably reinforced with various resins and polymers. It is most preferred that the two types of gasket materials as described above with respect to gasket layers 8 and 10 be alternated, the rubber material of gasket 8 being preferred for purposes of pliability and sealing with respect to coarsely machined surfaces and the wood pulp gaskets layers 10 be employed because of its stiffness and heat insulation properties. All these materials must, of course, be resistant to gasoline, and the overall environment for which it is intended.

Figure 4:
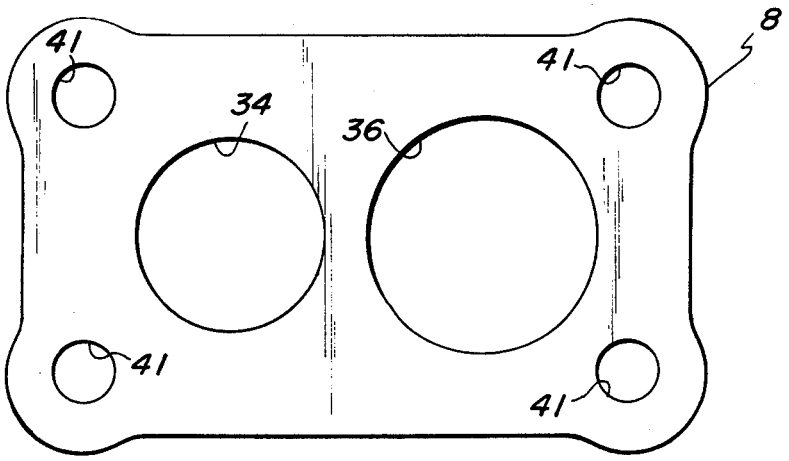
FIG. 4 is a top elevational view of one section of the gasket for use in the precombustion ionization device of the present invention.
Figure 5:
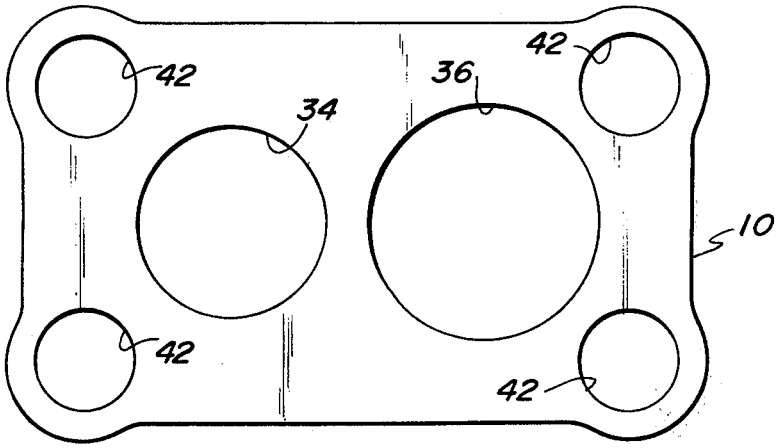
FIG. 5 is a top elevational view of another section of the gasket for use in the precombustion ionization device of the present invention.
Figure 6:
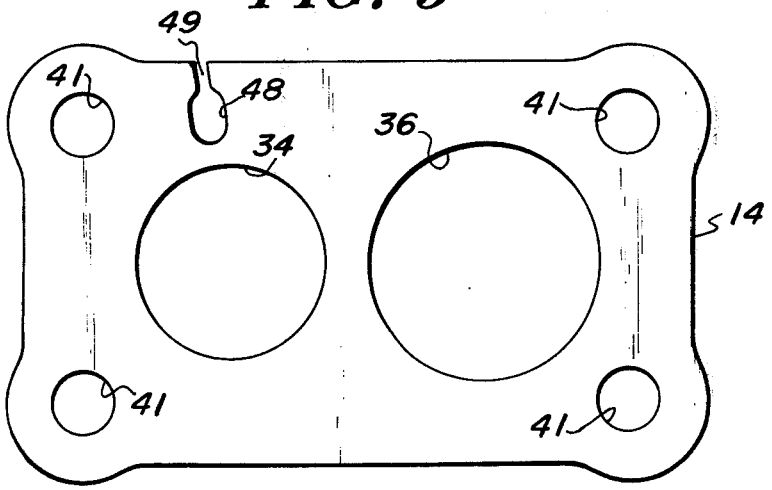
FIG. 6 is a top elevational view of another section of the gasket for use in the precombustion ionization device of the present invention.

As shown in FIG. 2, the overall gasket 6 includes a rubber gasket 8, followed by a wood gasket 10, followed by a pair of rubber gaskets 12 and 14, followed by another wood gasket 16, and finally by another rubber gasket 18. Preferably, the overall thickness of the gasket shown therein will be about 0.29 inches, although variations are, of course, possible therewith. With reference to FIGS. 4 through 6, the overall configuration of the gasket 6 is more clearly shown. Thus, each of the gasket layers of course includes both the primary opening 34 and the secondary opening 36. The neoprene rubber - asbestos filler gaskets, identified as rubber gasket 8, shown in FIG. 4, also includes four eyelet openings 41 therein. This is also true for the rubber gasket 14 shown in FIG. 6. While the wood fiber gasket 10 shown in FIG. 5 similarly contains four such eyelet openings, the openings as shown therein are larger than those with respect to the rubber gasket. These openings 42 are larger because of the nature of these gaskets, being less flexible and stiffer, the increased openings therefore permitting the eyelets to be inserted therein with greater ease, and permitting the gasket layers to be more firmly compressed together. It is therefore then possible to insert four eyelets 46 into these openings, in the manner shown in FIG. 2, in order to prepare the overall gasket 6, and compress the gasket layers together suitably. Preferably, brass eyelets of 0.275 inches in height are employed.

Referring to FIG. 5, the rubber gasket 14 is similar to rubber gasket 8, but includes a cutout portion 48, including throat section 49. The purpose of this cutout portion is to accomodate means for forming an electrical connection to the foraminous member disposed within the primary opening 34, as discussed below.

A similar gasket configuration is shown in FIG. 8, with respect to a single foraminous member 2, contained in a gasket including a single opening, for use with respect to single barrel carburetors. Thus, this gasket 32 includes alternating layers 20, 24, and 28 of neoprene rubber, and 22 and 26 of the wood-fiber material discussed above.

The out-turned flat peripheral zones of the wire cloths 38, 40 and 2 are desirably stiffened, that is to say reinforced, by crimping around each of the peripheries a thin annulus of metal such as, for example, low carbon steel, stainless steel or soft steel plated with a metal the same as the associated screen, which is of U-shaped cross-section with the base of the U facing outwardly. These crimped annular rings have been indicated by reference numerals 50 in FIG. 2 and 52 in FIG. 8.

As discussed above, the application of a voltage to the highly oxidized catalytic metal surface of the foraminous member of this invention tends to increase the intensity of ionization of the vaporized liquid fuel, and therefore to result in the substantial advantages of the present invention as discussed above. Preferably, a voltage of from about 4 to about 5,000 volts may be applied to the foraminous member, however this may include the use of from about 4 to 12 volts, such as when the automobile battery itself is employed as the source of voltage, or increased voltages if greater than 12 volts, up to about 5,000 volts, preferably greater than about 300 volts, such as from about 300 to 400 volts, or greater than about 1,000 volts in some cases. It is therefore possible, as noted, to apply voltage from the automobile battery, eg. 12 volts thereto. The positive effects thereof are more strikingly observed, however, at the higher voltages described above. It has also been found, however, that such high voltages sometimes also have the effect of electropolishing off the oxide coating in certain cases, i.e. particularly when it is a relatively soft oxide coating. That is, with metals such as zinc and cadmium, this can occur, in which case the advantages of the present invention can eventually be lost. One method of overcoming this problem, when employing the precombustion ionization device as shown in FIGS. 1 and 2, i.e. including at least two foraminous members, is to apply such voltages only to the outside or downstream member, and connecting the inside member only to ground. The outside member is then prepared preferably from a material having a harder oxide coating, such as nickel, which more effectively resists the effects of electropolishing.

On the other hand, it is possible to employ materials having extremely hard oxide coatings, in which case the effects of electropolishing are practically eliminated. For example, the use of an anodized aluminum foraminous member, and most preferably a pair of such members in the device shown in FIG. 2, has been found to be extremely advantageous when applying voltages to these members.

Figure 3:
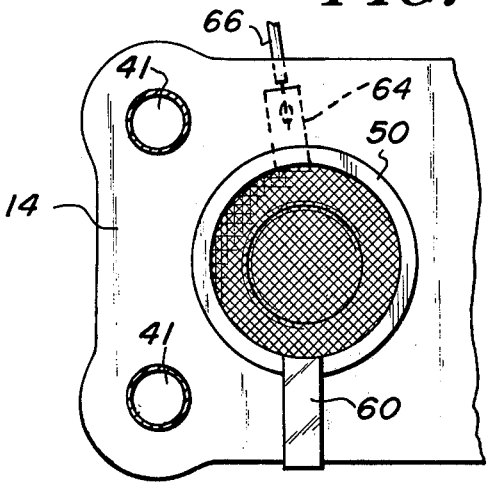
FIG. 3 is a partial top elevational view of a portion of the precombustion ionization device of FIG. 1, taken along lines 3—3 of FIG. 2.
Figure 7:
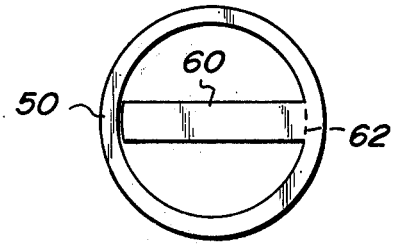
FIG. 7 is a top elevational view of a section of the support ring of the present invention before its completion.

The actual connection of the foraminous members to the source of voltage is accomplished by means of tabs applied to the peripheral zones of the wire cloth, that is the crimped annular rings 50 and 52. In a preferred embodiment, the foraminous member, and particularly the crimped annular ring is produced in a particular manner whereby the tab member is readily applied thereto. Thus, as shown in FIG. 7, the ring itself is manufactured including a depending tab portion 60 therewith, so that the entire upper portion as shown in FIG. 7 may be stamped in a single operation. Then, by merely bending tab 60 along dotted line 62 as shown in FIG. 7, a tab extending from the foraminous member is obtained. This tab is shown in FIG. 3 as extending beyond the gasket 14 thereof. It will therefore protrude from the gasket 6 as shown in FIG. 1. This tab 60 may then be employed as a means of grounding the foraminous member, such as to the base of the carburetor, or some other such suitable portion of the automobile. While it is also possible to employ a second tab, such as tab 60, extending from the other side of the second foraminous member as shown in FIG. 3, it has been found that when this tab is to be used for the application of the voltages of the present invention, whereby it is necessary to solder or weld a wire connection to the tab, when using soft metals such as carbon, steel and the like for the tabs, in this application the tabs easily break. Therefore, in the embodiments shown in the drawings, this tab 64 is shortened so that it does not extend beyond the edge of gasket number 14. The electrical connection, such as by soldering or welding, of wire 66 to the surface of tab 64 is therefore within the gasket itself, with the wire 66 extending therefrom. The other end of the wire may, of course, include a standard clip 70 for attachment to a source of voltage. Preferably, a 5,000 ohm carbon resistor 72 is maintained in line 68. Reference can now be made to the insert 48 cutout of gasket number 14 as shown in FIG. 6. The soldered wire connection at 66 may therefore rest in the opening 48, and the wire 68 may extend through the throat portion 49 of opening 48, so that the connection and the wire do not prevent sealing of the gasket and complete preparation of the overall gasket 6 by pressing the individual gasket layers together as discussed above.

As for the actual application of voltage itself, irrespective of the particular method for applying that voltage, it is necessary for applying that voltage in accordance with this invention that overall a positive voltage must be applied. That is, for example, where two foraminous members are used as in FIGS. 1–3, preferably the top member 40 will be grounded, such as by use of tab 60, while the bottom or downstream member 38 will be applied to a positive voltage, such as by tab 64 and the connection described with reference to FIG. 3. On the other hand, it is also possible to apply a positive voltage to both the upstream member 40 and the downstream member 38.

Figure 9:
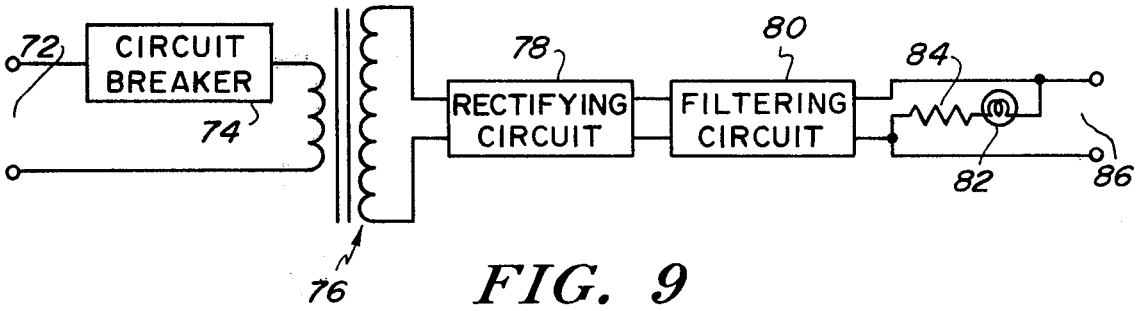
FIG. 9 is a schematic representation of a power pack for use in connection with the precombustion ionization device of the present invention.
Figure 10:
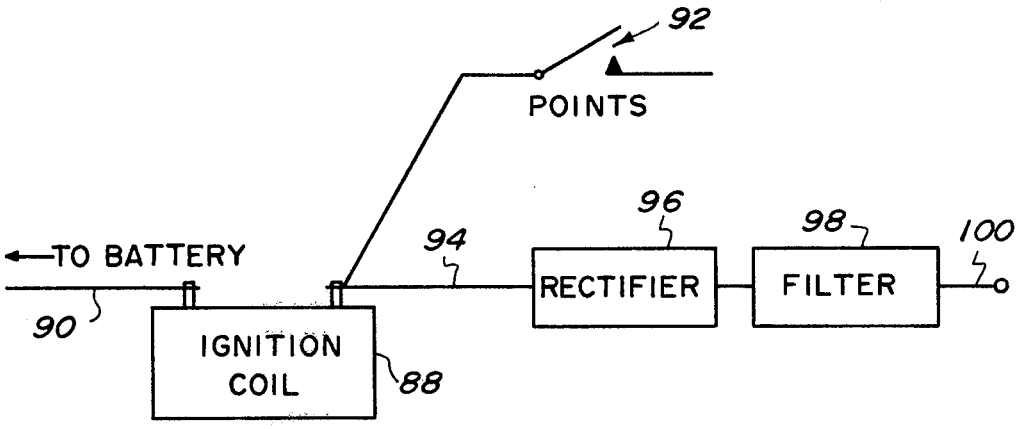
FIG. 10 is a schematic representation of the connection of the precombustion catalyst device of the present invention to an automobile battery.
Figure 11:
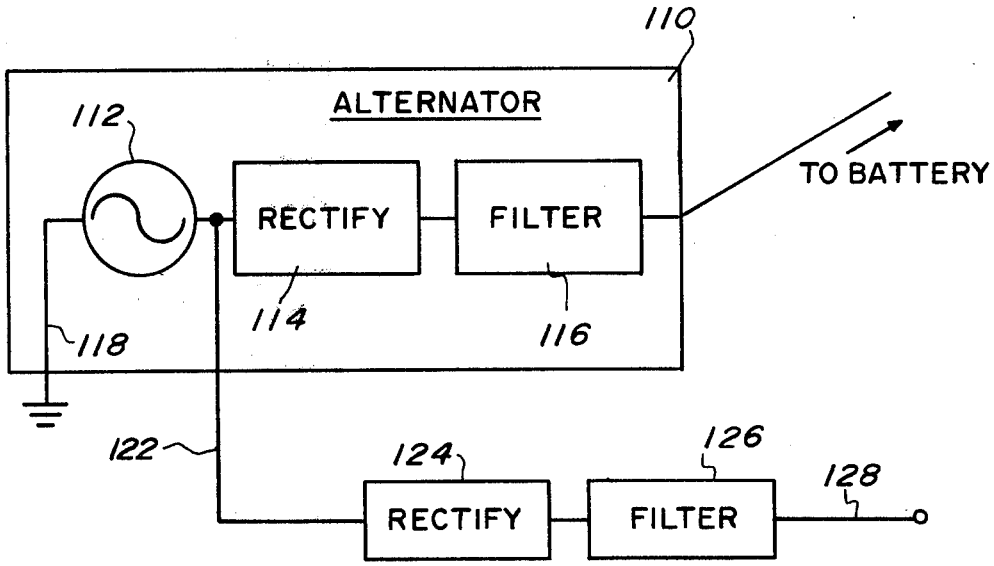
FIG. 11 is a schematic representation of the connection of the precombustion catalyst device of the present invention to an automobile alternator.

The actual application of a voltage to either one or both of the foraminous members hereof may be accomplished in several ways, as exemplified in FIGS. 9 through 11. Thus, as shown in FIG. 9, a source of direct current such as a battery 72 is utilized. By means of a multivibrator or circuit-breaker 74, the circuit is periodically broken, and an alternating current is produced from the direct current. Thus, by means of step-up transformer 76, an elevated AC voltage is produced, such as 400 volts or higher. Subsequently, by means of rectifying circuit 78, a direct current is again produced, which is then filtered in filtering circuit 80 so that the direct current thus produced is smoothed out. Finally, a light 82 may be employed to signify the presence of such voltage, protected by resistor 84. The elevated voltage at 86 may then be applied directly to one of the foraminous members of this invention as discussed above.

Alternatively, as shown in FIG. 10, the ignition coil 88 of an automobile may be employed as a source of such increased voltage. Thus, the ignition cell is directly connected to the auto battery by means of line 90, and is also directed to the points 92 in the automobile whereby the voltage is periodically shorted down to ground so that an increased alternating current is produced in line 94. By attaching a rectifier 96 thereto, again in combination with a filter 98, a substantially increased voltage is realized at 100, again for application to the foraminous members hereof.

In a third alternative, the automobile alternator 110, which is connected to the battery, is employed as a source of voltage. Thus, rectifier 114 and filter 116 are normally employed in connection with alternator 112. It is possible, however, to realize an increased voltage by connecting line 122 to the alternator as shown. This increased alternating voltage may then be connected to a direct current in rectifier 124, and filtered in filter 126, for supply by line 128 to the foraminous members of the present invention.

Another alternative for the application of energy to at least one of the foraminous members of the present precombustion ionization device is the application of heat rather than a voltage thereto. This may be accomplished, for example, by employing a highly-conductive metal so that heat is conducted to the foraminous member, and a relatively high current is applied thereto.

It should also be noted in connection with the application of a voltage, particularly where the voltage is obtained from an external source apart from the automobile battery itself, that this source must be grounded to the engine's electrical system.

As various possible embodiments might be made of the above invention and as various changes might be made in the embodiments set forth above, it is to be understood that all matters herein described or shown in the accompanying drawings are to be interpreted as illustrative and not in a limiting sense.

What is claimed is:

1. A precombustion ionization device for interposition between the carburetor and the engine intake of an internal combustion engine employing a vaporizable liquid fuel, said device comprising at least one foraminous member including a catalytic metal thereon, and an oxide coating of said catalytic metal on its surface so as to promote reduction of said liquid fuel, and thereby improve the octane rating of said engine, and a gasket supporting said foraminous member so that said foraminous member is in spaced relationship from said carburetor and said engine intake.

2. The ionization device of claim 1 including a source of voltage applied to said foraminous member.

3. The ionization device of claim 2 wherein said source of voltage applies at least 4 volts to said foraminous member.

4. The ionization device of claim 1 wherein said catalytic metal comprises a metal selected from the group consisting of nickel, zinc, aluminum, cadmium and platinum.

5. The ionization device of claim 1 including at least two foraminous members, each such foraminous member including a catalytic metal and an oxide coating of said catalytic metal on the surface thereof, and wherein said gasket separates each of said foraminous members from each other as well as separating said foraminous members from said carburetor and said engine intake.

6. The ionization device of claim 1 wherein said oxide coating is at least about 0.0001 inches thick.

7. The ionization device of claim 5 wherein said foraminous members are each prepared from a different catalytic metal.

8. The ionization device of claim 5 wherein said foraminous members are each prepared from the same catalytic metal.

9. The ionization device of claim 5 wherein a source of voltage is applied to one of said foraminous members.

10. The ionization device of claim 9 wherein said foraminous member to which said source of voltage is applied is in proximity to said carburetor.

11. The ionization device of claim 1 wherein heat is applied to said foraminous member.

12. The ionization device of claim 2 wherein said source of voltage comprises an automobile battery.

13. The ionization device of claim 1 wherein said gasket comprises of a plurality of gasket layers.

14. The ionization device of claim 2 wherein said source of voltage comprises an automobile alternator.

15. A precombustion ionization device for interposition between the carburetor and the engine intake of an internal combustion engine employing a vaporizable liquid fuel, said device comprising at least two foraminous members, each foraminous member including a catalytic metal thereon, and an oxide coating of said catalytic metal on the surface thereof so as to promote reduction of said liquid fuel, and thereby improve the octane rating of said engine, and a gasket supporting said foraminous members spaced from one another and spaced from the carburetor and from the engine intake.

16. The ionization device of claim 15 wherein at least one of said foraminous members is attached to a source of voltage.

17. The ionization device of claim 16 wherein said source of voltage applies a voltage of at least 4 volts thereto.

18. The ionization device of claim 17 wherein both of said foraminous members are attached to a source of voltage.

19. The ionization device of claim 15 wherein said foraminous members are each prepared from a different catalytic metal.

20. The ionization device of claim 15 wherein said foraminous members are prepared from the same catalytic metal.

21. The ionization device of claim 19 wherein said catalytic metals comprise a metal selected from the group consisting of nickel, zinc, aluminum, cadmium, and platinum.

22. The ionization device of claim 16 wherein said source of voltage comprises a power-pack providing at least 12 volts to said foraminous member.

23. The ionization device of claim 15 wherein said gasket comprises a plurality of gasket layers.

* * * * *